US008782850B2

(12) United States Patent
Yoo et al.

(10) Patent No.: US 8,782,850 B2
(45) Date of Patent: Jul. 22, 2014

(54) VACUUM CLEANER

(75) Inventors: Myung Sig Yoo, Changwon-si (KR); Man Tae Hwang, Changwon-si (KR); Hae Seock Yang, Changwon-si (KR); Moo Hyun Ko, Mungyeong-si (KR); Jong Su Choo, Busan (KR)

(73) Assignee: LG Electronics Inc., Seoul (KR)

( * ) Notice: Subject to any disclaimer, the term of this patent is extended or adjusted under 35 U.S.C. 154(b) by 988 days.

(21) Appl. No.: 11/711,905

(22) Filed: Feb. 28, 2007

(65) Prior Publication Data

US 2008/0172823 A1 Jul. 24, 2008

(30) Foreign Application Priority Data

Feb. 28, 2006 (KR) ..... 10-2006-0019526

(51) Int. Cl.
*A47L 9/10* (2006.01)

(52) U.S. Cl.
USPC ..... 15/352; 15/347

(58) Field of Classification Search
USPC ..... 15/352, 353, 350, 347; 55/327, DIG. 3
See application file for complete search history.

(56) References Cited

U.S. PATENT DOCUMENTS

| | | | | |
|---|---|---|---|---|
| 6,353,963 | B1 | 3/2002 | Bair et al. | |
| 6,746,500 | B1 * | 6/2004 | Park et al. | 55/343 |
| 2002/0088079 | A1 | 7/2002 | Oh | |
| 2004/0064912 | A1 | 4/2004 | Ji et al. | |
| 2005/0050863 | A1 * | 3/2005 | Oh | 55/345 |
| 2005/0125940 | A1 * | 6/2005 | McDowell | 15/353 |
| 2005/0138761 | A1 | 6/2005 | Park et al. | |
| 2005/0172584 | A1 * | 8/2005 | Oh et al. | 55/345 |
| 2005/0252179 | A1 * | 11/2005 | Oh et al. | 55/337 |
| 2007/0067943 | A1 * | 3/2007 | Makarov | 15/339 |
| 2007/0130895 | A1 | 6/2007 | Boeck et al. | |

FOREIGN PATENT DOCUMENTS

| | | |
|---|---|---|
| CN | 1177915 | 4/1998 |
| CN | 1434749 | 8/2003 |
| CN | 1729923 | 2/2006 |
| DE | 20109699 | 11/2001 |
| DE | 20306405 | 4/2003 |
| EP | 0181886 | 5/1986 |
| EP | 0836827 | 4/1998 |
| EP | 1042981 | 10/2000 |
| FR | 2619498 | 2/1989 |
| GB | 2368516 | 8/2002 |

(Continued)

OTHER PUBLICATIONS

Japanese Office Action dated Nov. 4, 2009.

(Continued)

*Primary Examiner* — Robert Scruggs
(74) *Attorney, Agent, or Firm* — Ked & Associates, LLP

(57) ABSTRACT

A vacuum cleaner includes a dust collector which includes a first dust separator and a dust container in which a first dust storage unit is formed. A cover is coupled to the dust separating unit and is used to selectively open or close the dust storage unit. The cover is detached from the dust container together with the dust separating unit when the dust container is emptied. The vacuum cleaner may further include a second dust separator on the main body of the vacuum cleaner. In this instance, a second dust storage unit may be formed in the dust collector, and dust separated in the second dust separator may be stored in the second dust storage unit.

31 Claims, 7 Drawing Sheets

(56) References Cited

FOREIGN PATENT DOCUMENTS

| | | |
|---|---|---|
| GB | 2375980 | 8/2003 |
| JP | 2003-190061 | 7/2003 |
| JP | 2003524522 | 8/2003 |
| JP | 2003-310500 | 11/2003 |
| JP | 2005007066 | 1/2005 |
| JP | 2005/324002 | 11/2005 |
| JP | 2005349099 | 12/2005 |
| JP | 4176994 | 11/2008 |
| KR | 10-2005-0025711 | 3/2005 |

OTHER PUBLICATIONS

Australian Office Action dated May 2, 2008.

Chinese Office Action dated Feb. 6, 2009 with Translation.

Japanese Office Action dated May 12, 2009.

European Search Report dated May 27, 2009.

Korean Office Action issued in KR Application No. 10-2006-0019526 dated Sep. 18, 2012.

Chinese Office Action for Application No. 200710087650.4 dated Jan. 6, 2011 with English translation.

* cited by examiner

VACUUM CLEANER

BACKGROUND

1. Field

The present invention relates to a dust collector for a vacuum cleaner, and more particularly, to a dust collector having an improved structure for easily discharging collected dust.

2. Background

Generally, a vacuum cleaner uses negative pressure generated by a suction motor installed inside the main body of the vacuum cleaner to suction air containing dust and then to filter the dust from the air. Vacuum cleaners can be largely divided into canister type vacuum cleaners that have a suctioning nozzle provided separately from the main body, and upright vacuum cleaners in which a nozzle is integrated with a main body. Vacuum cleaners according to the related art include a main body and a dust collector that collects dust separated from air that flows into the main body.

The dust collector is typically detachably installed on the main body so that dust stored in the dust collector can be easily removed after detaching the dust collector from the main body. However, when emptying the related art dust collector, the indoor space that has been vacuumed is prone to be re-contaminated. This often occurs during the process of separating the dust collector from the main body of the vacuum cleaner, or when dust is discharged from the dust collector. If the indoor space is thus re-contaminated while a user empties the dust collector, the user must clean the contaminated area again. Accordingly, development of a dust collector that prevents re-contamination of a vacuumed inner space and which facilitates emptying of dust when a user empties dust stored inside the dust collector is required.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to preferred embodiments, examples of which are illustrated in the accompanying drawings. Wherever possible, the same reference numbers will be used throughout the drawings to refer to the same or like parts.

Figure 1:
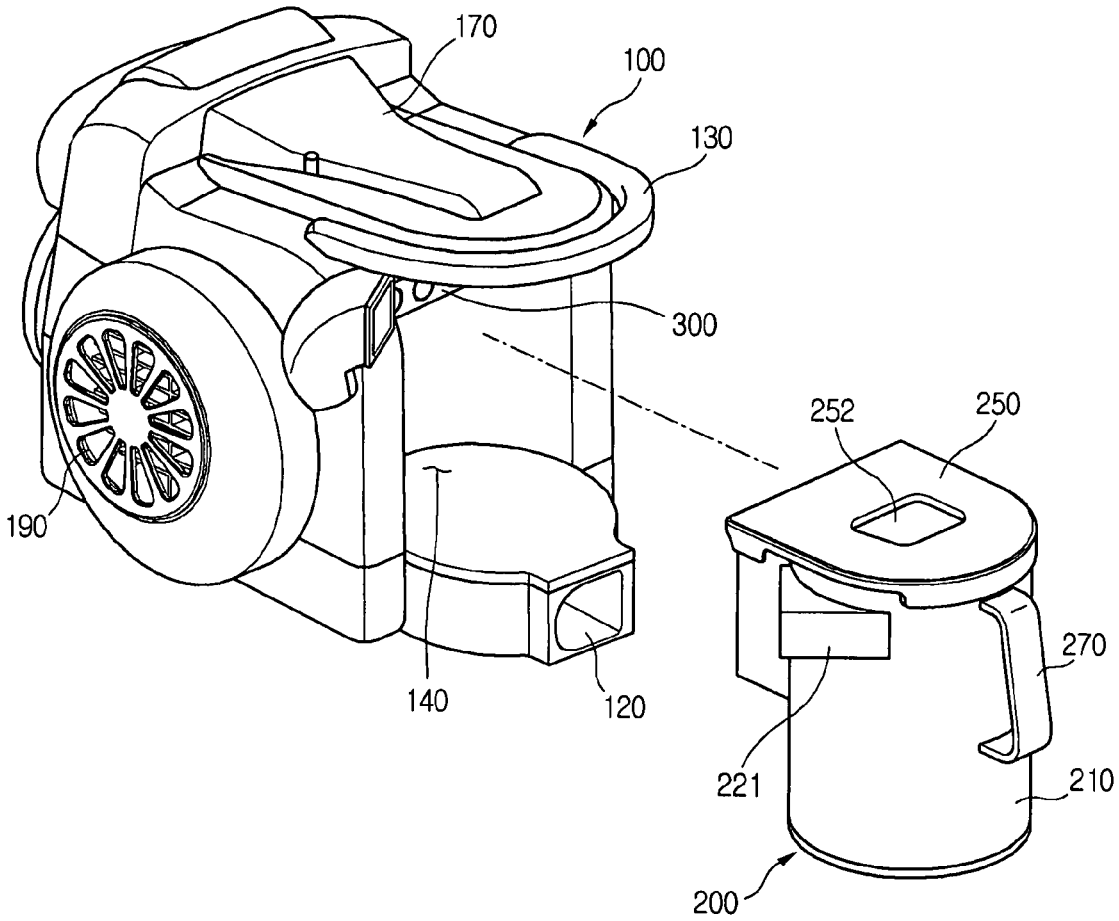
FIG. 1 is a perspective view illustrating a vacuum cleaner and a dust collector detached from the vacuum cleaner according to a first embodiment.
Figure 2:
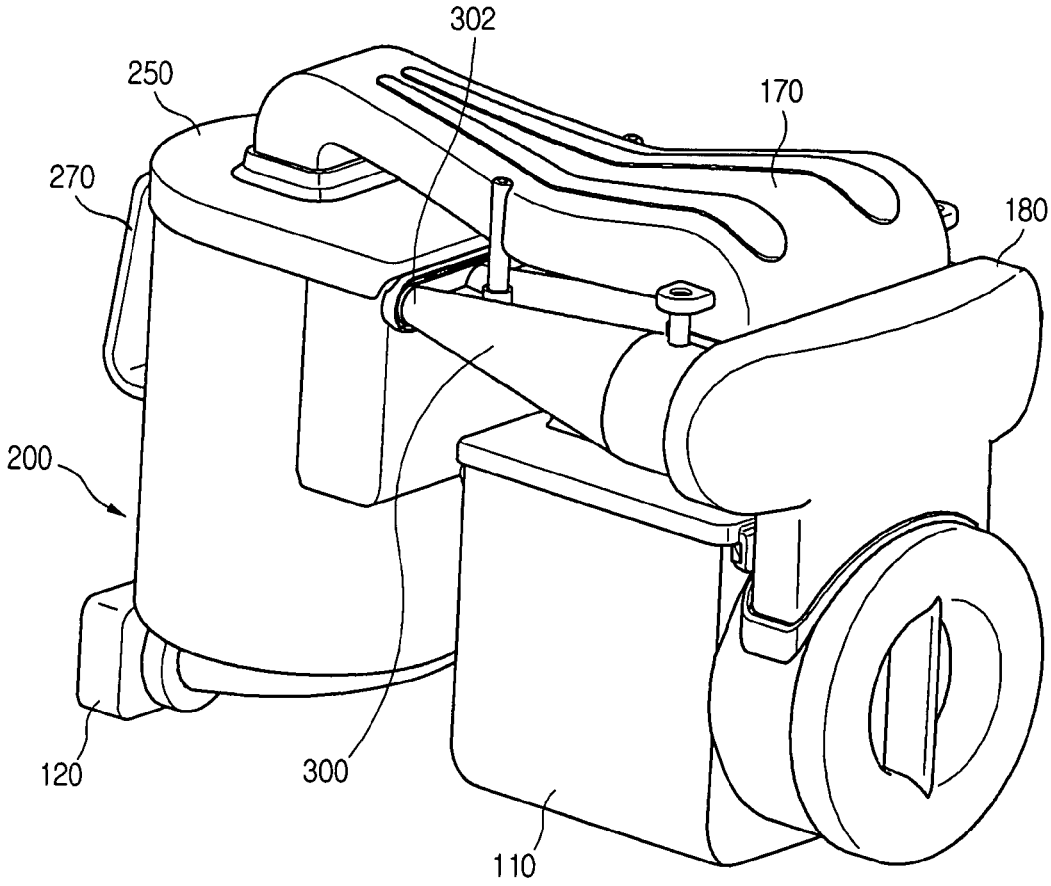
FIG. 2 is a perspective view illustrating the vacuum cleaner, and the dust collector installed on the vacuum cleaner, according to the first embodiment.
Figure 3:
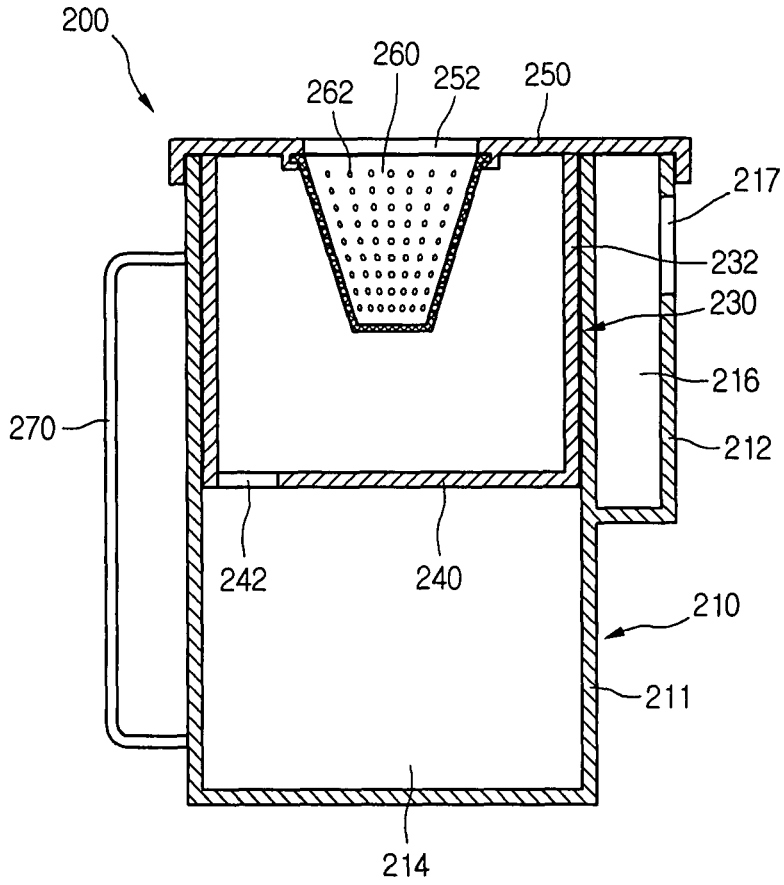
FIG. 3 is a schematic sectional view illustrating the dust collector according to the first embodiment.

Referring to FIGS. 1 to 3, a first embodiment of a vacuum cleaner includes a main body 100 and a dust collector. The main body 100 includes a driving unit 110 for a generating suction force, and a dust separator separates and collects dust from air sucked into the vacuum cleaner. The vacuum cleaner further includes a suction nozzle (not shown) for sucking air into the vacuum cleaner and a connection tube (not shown) for connecting the suction nozzle to the main body 100. The suction nozzle and the connection tube have the same structures as those of a related-art vacuum cleaner. Thus, descriptions of the suction nozzle and connection tube will be omitted.

The main body 100 further includes a suction port 120 and a discharge port 190. The suction port 120 is formed in a front lower portion of the main body 100 and is connected to the suction nozzle. The discharge port 190 is formed in a side portion of the main body 100 for discharging air after dust has been separated from the air by the dust collector 200. The driving unit 110 includes a suction motor for generating a suction force to draw outside air into the vacuum cleaner through the nozzle.

In some embodiments, the vacuum cleaner may include a first dust separating unit such as a first cyclone unit 230, and a second dust separating unit such as a second cyclone unit 300. The first cyclone unit 230 may be included in the dust collector 200, and the second cyclone unit 300 may be mounted on the main body 100. The first cyclone unit 230 separates dust from air introduced in the vacuum cleaner, and then the second cyclone unit further separates dust from the air after it has passed through the first cyclone unit 230. The second cyclone unit 300 communicates with the dust collector 200 when the dust collector 200 is installed on the main body 100.

The dust collector 200 includes the first cyclone unit 230 for separating dust from sucked air and a dust container 210. In some embodiments, the dust container 210 may be detachably coupled to the first cyclone unit 230. Preferably, the first cyclone unit 230 is detachably coupled to the dust container 210 and has a cylindrical outer wall.

The dust collector 200 includes a first air-suction port 221 at an upper side portion. Air is introduced into the first cyclone unit 230 through the first air-suction port 221 of the dust collector 200 and is swirled along an inner wall of the first cyclone unit 230. For this, the first cyclone unit 230 includes a suction hole (not shown) corresponding to the first air-suction port 221 of the dust collector 200.

The dust container 210 stores dust separated from air by the first and second cyclone units 230 and 300. The dust container 210 includes a first dust storage unit 214 for storing dust separated by the first cyclone unit 230 and a second dust storage unit 216 for storing dust separated by the second cyclone unit 300.

The second dust storage unit 216 communicates with the second cyclone unit 300 when the dust collector 200 is installed on the main body 100. Dust separated from air by the second cyclone unit 300 is sent to the second dust storage unit 216 through a dust introduction hole 217 of the second dust storage unit 216.

In some embodiments, the second dust storage unit 216 is integrally formed on the dust collector 200. In other embodiments, the second dust storage unit 216 can be formed separate from the dust collector 200. In the current embodiment, the second dust storage unit 216 and the first dust storage unit 214 are formed inside the dust collector 200.

The dust container 210 includes a first wall 211 forming the first dust storage unit 214 and a second wall 212 forming the second dust storage unit 216 together with the first wall 211. That is, the second wall 212 covers a predetermined portion of the exterior of the first wall 211. Thus, the second dust storage unit 216 is formed at an outside portion of the first dust storage unit 214. Since the second dust storage unit 216 is formed outside the first dust storage unit 214, the first dust storage unit 214 can have a large size for receiving a large amount of dust.

The top of the dust collector 200 is opened such that dust can be removed from the dust container 210 by turning the dust collector 200 upside down. An upper cover 250 is detachably coupled to the opened top of the dust collector 200. Furthermore, the upper cover 250 is coupled to an upper portion of the first cyclone unit 230, such that the upper cover 250 and the first cyclone unit 230 can be detached from the dust collector 200 when dust is removed from the dust container 210.

A hollow filter member 260 is coupled to the upper cover 250. The filter member 260 is formed with a plurality of penetration holes 262 having a predetermined size. The upper cover 250 includes a first air discharge hole 252 for discharging air after the air passes through the filter member 260. After dust is separated from air in the first cyclone unit 230, the air is discharged from the dust collector 200 through filter member 260 and the first air discharge hole 252.

The upper cover 250 closes and opens both the first and second dust storage units 214 and 216. When the upper cover 250 coupled to the first cyclone unit 230 is detached from the dust collector 200, the top of the dust collector 200 is entirely opened. After that, dust collected in the first and second dust storage units 214 and 216 can be easily discharged by turning the dust collector 200 upside down. That is, when the upper cover 250 is detached from the dust collector 200, the top portions of the first and second dust storage units 214 and 216 are both opened. Thus, dust can be easily discharged from the first and second dust storage units 214 and 216 by turning the dust collector 200 upside down.

The upper cover 250 can be detached from the dust container 210 to remove dust from the dust collector 200 after carrying the dust container 210 to an outside area or a trash bin. The cover prevents an indoor area from being contaminated by the dust in the dust container 210 as the dust collector 200 is removed from the main body, and as the dust collector is transported to a disposal area.

Preferably, an anti-scattering member 240 is formed at a lower portion of the first cyclone unit 230 to prevent dust collected in the first dust storage unit 214 from scattering towards the first cyclone unit 230, as might be caused by a swirling movement of air. In the current embodiment, the anti-scattering member 240 may be a bottom wall of the first cyclone unit 230 or a separate part attached to the first cyclone unit 230.

The anti-scattering member 240 includes an opening 242 through which dust separated from air in the first cyclone unit 230 is discharged to the first dust storage unit 214. That is, dust separated from air in the first cyclone unit 230 moves down to the first dust storage unit 214 through the opening 242. The opening 242 is formed at an edge of the anti-scattering member 240. Preferably, one or more openings 242 may be formed along a circular path along the outer edge of the anti-scattering member 240.

Preferably, a handle 270 is formed on an outer surface of the dust collector 200. In this case, the dust collector 200 can be easily attached to or detached from the main body 100 using the handle 270. Furthermore, the dust collector 200 can be easily carried using the handle 270.

In this embodiment, the second cyclone unit 300 is formed on the main body 100. The second cyclone unit 300 further separates dust from air after the air has passed through the first cyclone unit 230. The main body 100 includes a dust container mount 140 for receiving the dust collector 200. The second cyclone unit 300 is formed above the dust container mount 140. Preferably, the second cyclone unit 300 may be disposed in the main body 100 in a laid-down position. Because the second cyclone unit 300 is disposed on the main body 100 in a laid-down position, interference with other components such as the driving unit 110 can be prevented. Therefore, efficiency in the utilization of space and components can be increased, and thus the size of the vacuum cleaner can be reduced.

In the current embodiment, as shown in FIG. 2, the second cyclone unit 300 is laid down in a direction approximately perpendicular to the center axis of the circular first cyclone unit 230. The driving unit 110 is disposed under the second cyclone unit 300.

The second cyclone unit 300 can have various shapes. Preferably, the second cyclone unit 300 may have a shape suitable for separating dust from air by a centrifugal force. In the current embodiment, each cyclone part of the second cyclone unit 300 is cone-shaped.

A communication duct 170 is disposed between the first and second cyclone units 230 and 300 for connecting the first and second cyclone units 230 and 300. One end of the communication duct 170 is connected to the upper cover 250, the other end of the communication duct 170 is a second air-suction port (not shown) of the second cyclone unit 300.

When the dust collector 200 is mounted on the dust container mount 140, a dust discharge hole 302 formed at an end of the second cyclone unit 300 is connected to the dust introduction hole 217 of the second dust storage unit 216.

As explained above, the second cyclone unit 300 is included on the main body 100, and dust separated by the second cyclone unit 300 is stored in the second dust storage unit 216 formed in the dust collector 200. Because the second cyclone unit 300 is not formed on the dust collector 200, the dust collector 200 can be simple and light. Thus, the dust collector 200 can be easily detached from the main body 100 for removing collected dust.

It is preferable that the amount of dust collected in the first dust storage unit 214 be viewed from the outside. For this purpose, the first dust storage unit 214 may include a transparent outer wall that is directly exposed to the outside. Therefore, it can be easily determined when to empty the dust collector 200 since the inside of the first dust storage unit 214 where most of collected dust is stored can be viewed.

Hereinafter, an operation of the vacuum cleaner will be described.

When the driving unit 110 is powered on, the driving unit 110 generates a suction force for drawing outside air containing dust into the vacuum cleaner through the suction nozzle. The outside air sucked through the suction nozzle is introduced to the first air-suction port 221 of the dust collector 200 through the suction port 120 of the main body 100. The air is guided from the first air suction port 221 into the first cyclone unit 230 along a tangential direction of the inner wall of the first cyclone unit 230 so as to be swirled in the first cyclone unit 230. Therefore, dust contained in the air is separated from the air by a centrifugal force and is moved down by gravity to the first dust storage unit 214. The dust collected in the first dust storage unit 214 is not scattered back to the first cyclone unit 230 owing to the anti-scattering member 240.

After dust is first separated from the air by the first cyclone unit 230, the air is moved upward through the filter member 260 and the first air discharge hole 252. Then, the air flows to the second cyclone unit 300 along the communication duct 170 connected to the first air discharge hole 252.

The air is guided by the second air suction port (not shown) connected to an end of the communication duct 170 into each cyclone part of the second cyclone unit 300 in a tangential direction of the inner wall of the cyclone part. In the second cyclone unit 300, dust is further separated from the air by a centrifugal force and the separated dust is sent to the second dust storage unit 216 connected to an end of the second cyclone unit 300.

Thereafter, the air is guided from the second cyclone unit 300 back to the main body 100 in which fine dust is finally separated from the air by a filter (not shown). After passing through the filter, the air passes through the driving unit 110 and is discharged from the main body 100 through the discharge port 190.

After a predetermined amount of dust is collected in the dust collector 200, it becomes necessary to empty the dust collector 200. To accomplish this, the user first detaches the dust collector 200 from the main body 100. Then, the upper cover 250 where the first cyclone unit 230 is coupled is detached from the dust container 210 of the dust collector 200. After that, the dust container 210 can be easily emptied by turning the dust container 210 upside down.

Figure 4:
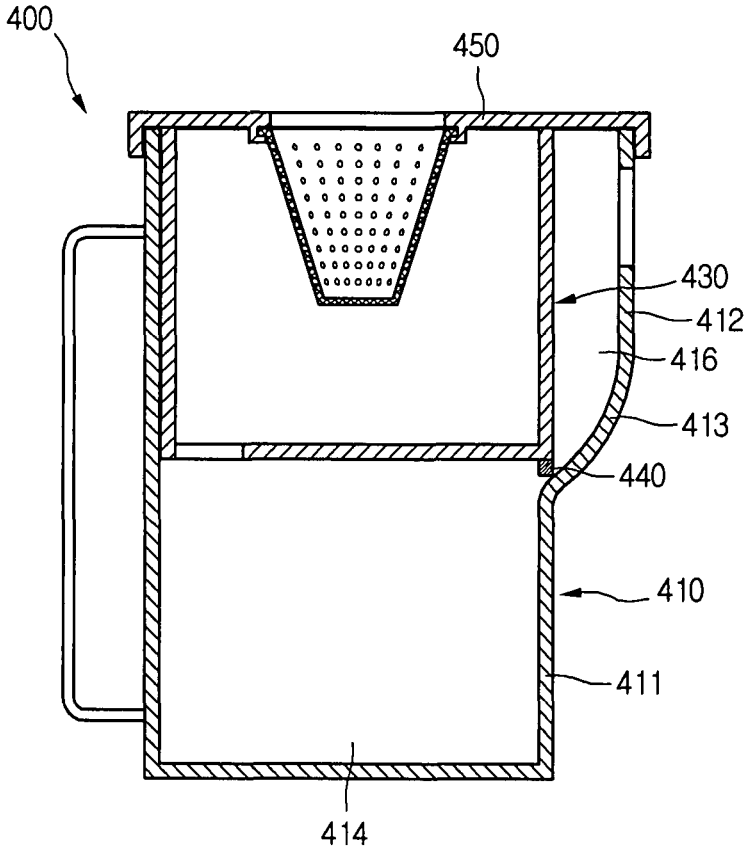
FIG. 4 is a sectional view illustrating a dust collector according to a second embodiment.

FIG. 4 is a sectional view illustrating a dust collector 400 according to a second embodiment. Referring to FIG. 4, the dust collector 400 of the second embodiment includes a first cyclone unit 430 for separating dust from sucked air, an upper cover 450 coupled to an upper portion of the first cyclone unit 430, and a dust container 410 to which the upper cover 450 is detachably coupled.

The dust container 410 includes a first wall section 411 and a second wall section 412. The first wall section 411 forms a lower portion of the dust container 410 and has a cylindrical shape. The second wall section 412 extends upward from the first wall section 411 and forms a space having a diameter larger than that formed by the first wall section 411.

Because, the first and second wall sections 411 and 412 have different sizes, an expanding joining portion 413 is formed between the first and second wall portions 411 and 412. The first cyclone unit 430 is stably disposed on the joining portion 413.

When the first cyclone unit 430 is accommodated in the dust container 410 and disposed on the joining portion 413, an inside space of the dust container 410 is divided into first and second dust storage units 414 and 416 by the first cyclone unit 430. That is, a separate wall is not formed to divide the inside space of the dust container 410 into the first and second dust storage units 414 and 416 in the current embodiment. Instead, the inside space of the dust container 410 is divided into the first and second dust storage units 414 and 416 by an outer wall of the first cyclone unit 430.

When the upper cover 450 to which the first cyclone unit 430 is coupled is detached from the dust container 410 to discharge dust collected in the first and second dust storage units 414 and 416, the first and second dust storage units 414 and 416 communicate with each other.

Because an additional compartment wall is not formed in the dust container 410, dust collected in the dust container 410 can be removed more easily. Furthermore, the dust container 410 can be cleaned more easily.

Preferably, the dust container 410 includes a sealing member 440 for sealing between the first and second dust storage units 414 and 416. The sealing member 440 can be formed on the joining portion 413 or on the first cyclone unit 430.

Preferably, the joining portion 413 may be rounded with a predetermined curvature. In this case, when the upper cover 450 is detached from the dust container 410, dust collected in the second dust storage unit 416 can easily slide down to the first dust storage unit 414 along the joining portion 413. Therefore, dust can be easily removed from the dust container 410 by turning the dust container 410 upside down. Furthermore, since the opened top of the dust container 410 is larger than the first dust storage unit 414, dust can be removed from the dust container 410 more easily.

Figure 5:
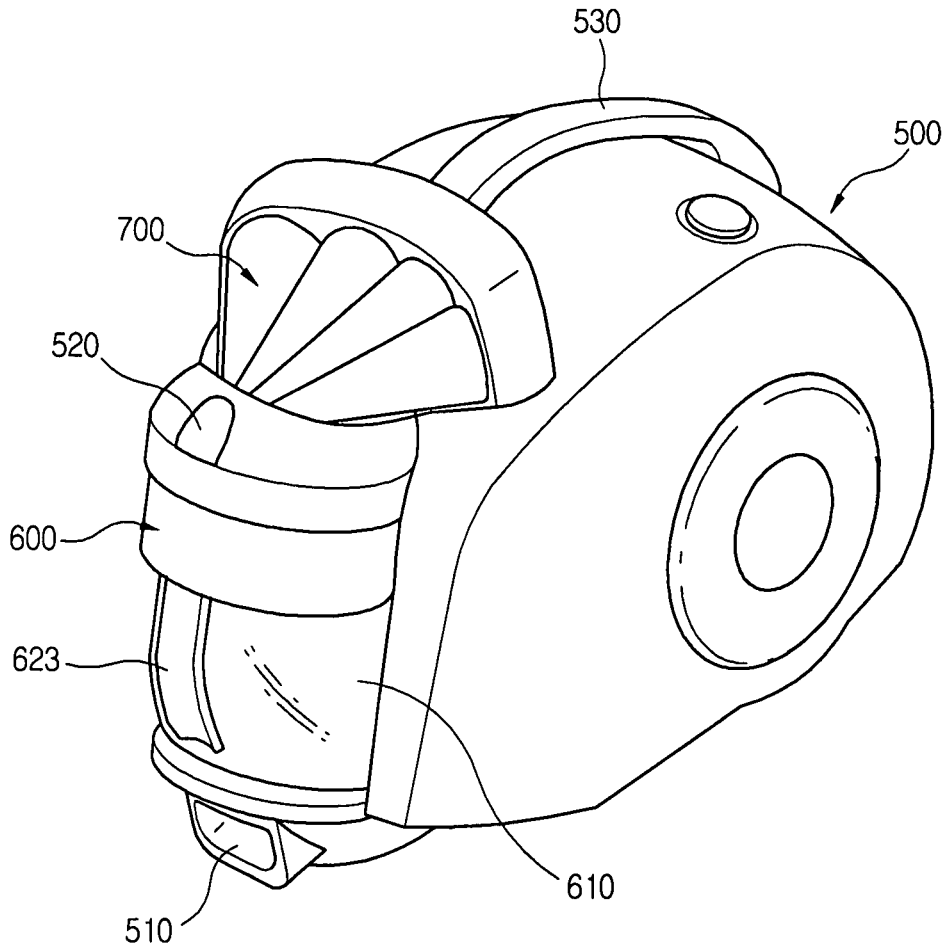
FIG. 5 is a perspective view illustrating a vacuum cleaner according to a third embodiment.
Figure 6:
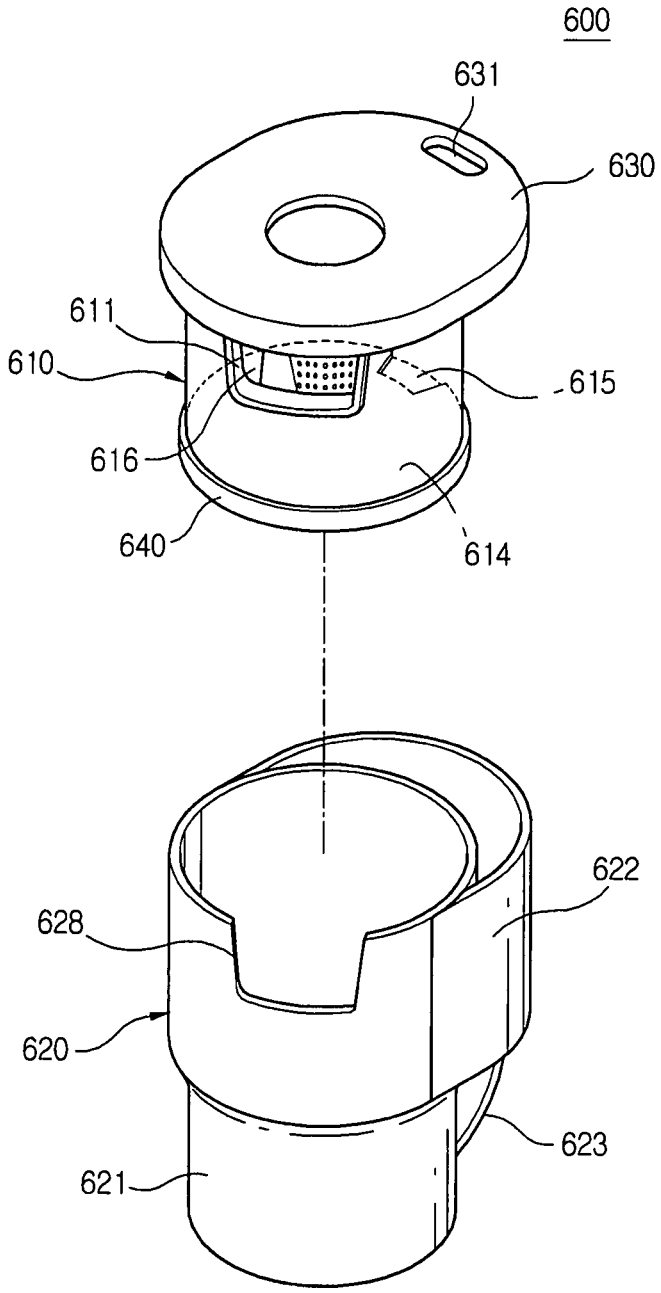
FIG. 6 is an exploded perspective view illustrating a dust collector according to the third embodiment.
Figure 7:
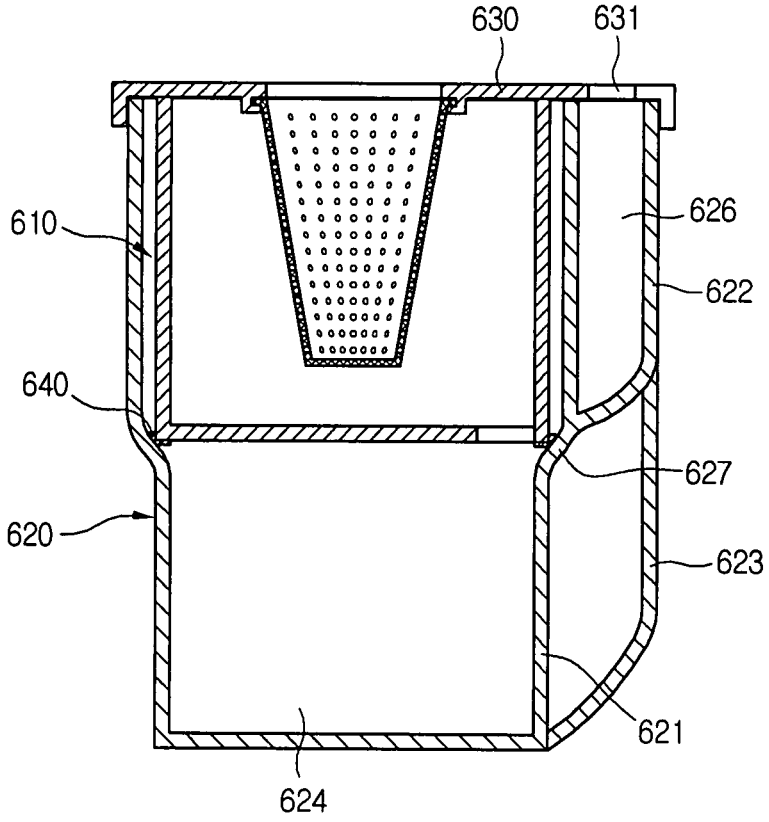
FIG. 7 is a schematic sectional view illustrating the dust collector according to the third embodiment.

FIG. 5 is a perspective view illustrating a vacuum cleaner according to a third embodiment, FIG. 6 is an exploded perspective view illustrating a dust collector according to the third embodiment, and FIG. 7 is a schematic sectional view illustrating the dust collector according to the third embodiment.

Referring to FIGS. 5 to 7, the vacuum cleaner of the third embodiment includes a main body 500 and a dust collector 600 installed on the main body 500. The main body 500 includes a suction port 510 and a discharge port (not shown). The suction port 510 is formed in a front lower portion of the main body 500 and is connected to a suction nozzle (not shown). The discharge port is formed in a side portion of the main body 500 to discharge air from the vacuum cleaner after dust is separated from the air.

The main body 500 further includes a second dust separating unit such as a second cyclone unit 700 at an upper portion. When the dust collector 600 is installed to the main body 500, the second cyclone unit 700 communicates with the dust collector 600.

Other parts of the main body 500 have substantially the same structures as those of the main body 100 discussed for the previous embodiments. Thus, descriptions thereof will be omitted.

The dust collector 600 is detachably coupled to a front portion of the main body 500. A separating unit 520 is formed at a front upper portion of the main body 500. A user would press on the separating nit 520 to release the dust collector 600 when the dust collector 600 is detached from the main body 500. In addition, a handle 530 is formed on an upper portion of the main body 500 such that the main body 500 can be easily carried using the handle 530.

The dust collector 600 includes a first dust separating unit such as a first cyclone unit 610 for separating dust from sucked air. A cover 630 is coupled to an upper portion of the first cyclone unit 610. The cover 630 is detachably coupled to a dust container 620.

The first cyclone unit 610 includes a first air-suction port 611 in an upper sidewall. A guide rib 616 is formed on an inner wall of the first air-suction port 611 to guide air introduced into the first cyclone unit 610 through the first air-suction port 611 approximately in a tangential direction of an inner wall of the first cyclone unit 610.

The dust container 620 includes first and second dust storage units 624 and 626. The first dust storage unit 624 stores dust separated by the first cyclone unit 610, and the second dust storage unit 626 stores dust separated by the second cyclone unit 700.

The dust container 620 includes first and second wall portions 621 and 622. The first wall portion 621 forms the first dust storage unit 624, and the second wall portion 622 forms the second dust storage unit 626 together with the first wall 621 portion.

That is, the second wall portion 622 encloses a predetermined portion of the first wall portion 621 to form the second dust storage unit 626. Therefore, the second dust storage unit 626 is formed at an outside of the first dust storage unit 624.

The first wall portion 621 includes a joining portion 627 along a circumferential direction to support a bottom portion of the first cyclone unit 610 when the first cyclone unit 610 is disposed in the dust container 620. Thus, an upper portion of the first wall portion 621 formed above the joining portion 627 has a diameter that is larger than that the diameter of the first wall portion 621 formed under the joining portion 627.

A groove 628 is formed in an upper edge of the dust container 620 for coupling with the first air-suction port 611 of the first cyclone unit 610. Therefore, when the first cyclone unit 610 is inserted into the dust container 620, the first air-suction port 611 is disposed in the groove 628.

The dust container 620 has an opened top, such that dust collected in the dust container 620 can be easily removed by turning the dust container 620 upside down. The cover 630 is detachably coupled to the opened top of the dust container 620. The cover 630 includes a dust introduction hole 631 through which dust separated by the second cyclone unit 700 is discharged to the second dust storage unit 626.

In addition, an anti-scattering member 614 is formed on a bottom portion of the first cyclone unit 610 as an integral part of the first cyclone unit 610 in order to prevent dust collected in the first dust storage unit 624 from being scattered by swirling air of the first cyclone unit 610. The anti-scattering member 614 includes an opening 615 through which dust separated from air in the first cyclone unit 610 is discharged to the first dust storage unit 624.

Furthermore, it is preferable that the dust collector 600 includes a sealing member 640 for preventing leakage of air between the first cyclone unit 610 and the first wall 621. The sealing member 640 is formed on one of the dust container 620 and the first cyclone unit 610. For example, the sealing member 640 can be formed on the joining portion 627 of the dust container 620 or a lower portion of the first cyclone unit 610.

In the current embodiment, the sealing member 640 has a circular shape running along a lower edge of the cylindrical first cyclone unit 610. The sealing member 640 is tightly attached to the joining portion 627 for hermetic sealing. Therefore, air from a place other than the first cyclone unit 610 cannot be introduced into the first dust storage unit 624, and air can be swirled in the first cyclone unit 610 more effectively.

Although the embodiments of the present invention are described for canister type vacuum cleaners, the present invention can be applied to other types of vacuum cleaners such as an upright type vacuum cleaner and a robot cleaner.

It will be apparent to those skilled in the art that various modifications and variations can be made to an embodiment of the invention. Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although a number of illustrative embodiments have been described, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus for a vacuum cleaner, comprising:

a dust container;

a first cyclone dust separator received within the dust container, the first cyclone dust separator having an opened top and a closed bottom, wherein dust separated from incoming air in the first dust separator is stored in the dust container, the closed bottom of the first cyclone dust separator including a dust outlet;

a filter member disposed within the first cyclone dust separator and having one or more penetration holes;

a second dust separator provided outside of the dust container, wherein dust separated in the second dust separator is stored in the dust container; and a cover that is removably mounted on the dust container to close the dust container and the opened top of the first cyclone dust separator, wherein the first cyclone dust separator and the filter member are attached to the cover such that the first cyclone dust separator is removed from the dust container along with the cover when the cover is removed, wherein the air is separated from the dust in the first cyclone dust separator and then passes through the one or more penetration holes of the filter member.

2. The apparatus of claim 1, wherein the dust container comprises:

a first dust storage unit, wherein dust separated in the first cyclone dust separator is stored in the first dust storage unit; and a second dust storage unit, wherein dust separated in the second dust separator is stored in the second dust storage unit.

3. The apparatus of claim 2, wherein the first dust storage unit is separated from the second dust storage unit.

4. The apparatus of claim 3, wherein the second dust storage unit is located adjacent an exterior surface of a wall of the first dust storage unit.

5. The apparatus of claim 2, wherein the first cyclone dust separator partitions the first dust storage unit from the second dust storage unit.

6. The apparatus of claim 5, further comprising:

a sealing member mounted on one of an inner wall of the dust container or an outer wall of the first cyclone dust separator, wherein the sealing member seals the first dust storage unit from the second dust storage unit.

7. The apparatus of claim 5, wherein a wall of the dust container has a first portion that forms the first dust storage unit and a second portion that forms the second dust storage unit, and wherein the second portion of the wall has a greater diameter than the first portion.

8. The apparatus of claim 7, wherein a joining portion of the wall joins the first portion and the second portion, and wherein a base portion of the first cyclone dust separator abuts the joining portion of the wall to separate the first dust storage unit from the second dust storage unit.

9. The apparatus of claim 8, wherein the joining portion of the wall curves outwardly from the first portion to the second portion.

10. The apparatus of claim 7, wherein the wall further comprises a joining portion that curves outwardly from the first portion to the second portion. wherein the joining portion supports a lower surface of the first cyclone dust separator.

11. The apparatus of claim 2, wherein a dust introduction hole is formed on an outer wall of the second dust storage unit such that dust from the second dust separator is introduced into the second dust storage unit via the dust introduction hole.

12. The apparatus of claim 2, wherein a dust introduction hole is formed in the cover at a location over the second dust storage unit such that dust from the second dust separator is introduced into the second dust storage unit via the dust introduction hole.

13. The apparatus of claim 1, wherein a cutaway portion is formed on an upper part of a wall of the dust container, wherein the first cyclone dust separator includes an inlet flange, and wherein the inlet flange of the first cyclone dust separator is received in the cutaway portion of the wall of the dust container when the first cyclone dust separator is received in the dust container.

14. The apparatus of claim 13, wherein the inlet flange of the first cyclone dust separator directs air entering the first cyclone dust separator in a tangential direction along an inner surface of the first cyclone dust separator.

15. The apparatus of claim 1, wherein the cover closes an upper surface of both the first dust storage unit and the second dust storage unit.

16. A vacuum cleaner comprising the apparatus of claim 1.

17. The apparatus of claim 1, wherein the dust container includes:

a first storage area; and a second storage area, wherein:

the first storage area receives dust separated by the first cyclone dust separator, the second storage area receives dust separated by the second dust separator, and a bottom surface of the first storage area and a bottom surface of the second storage area are on different planes.

18. The apparatus of claim 17, wherein the bottom surface of the second storage area is on a higher plane than the bottom surface of the first storage area.

19. The apparatus of claim 18, wherein the bottom surface of the first storage area is in contact with dust separated by the first cyclone dust separator and the bottom surface of the second storage area is in contact with dust separated by the second dust separator.

20. The apparatus of claim 17, wherein the bottom surface of the second storage area is substantially on a same plane as a bottom surface of the first cyclone dust separator.

21. The apparatus of claim 20, wherein dust in the second storage area falls into the first storage area when the first cyclone dust separator is removed from the dust container.

22. The apparatus of claim 1, wherein the second dust separator includes a plurality of cyclone units, and wherein an axis passing through each cyclone unit crosses an axis passing through the first cyclone dust separator.

23. The apparatus of claim 1, wherein:

the dust container has a first dust storage unit, a second dust storage unit, and an air suction portion to receive an inflow of air containing dust;

dust separated by the first cyclone dust separator is stored in the first dust storage unit, the first cyclone dust separator having a suction port to receive incoming air; and the air containing dust passes through the air suction port of the dust container and then passes through the suction port of the first cyclone dust separator.

24. An apparatus for a vacuum cleaner, comprising:

a dust container comprising a first portion having a first diameter, a second portion having a second larger diameter, the second diameter being greater than the first diameter, and a joining portion that joins the first portion to the second portion;

a first cyclone dust separator received within the first portion of the dust container and having an opened top and a closed bottom, wherein the closed bottom contacts the joining portion;

a filter member disposed within the first cyclone dust separator and having one or more penetration holes;

a second dust separator provided outside of the dust container, wherein dust separated by the second dust separator is stored in the dust container; and a cover that is removably mounted on the dust container to close the dust container and the opened top of the first cyclone dust separator, wherein the first cyclone dust separator and the filter member are attached to the cover.

25. The apparatus of claim 24, further comprising a sealing member provided at a lower portion of the first cyclone dust separator, wherein the sealing member forms a seal with the joining portion.

26. The apparatus of claim 24, wherein the first portion of the dust container forms a first dust storage unit, and wherein dust separated in the first cyclone dust separator is stored in the first dust storage unit.

27. The apparatus of claim 26, wherein a second dust storage unit is located adjacent an outside surface of the second portion of the dust container.

28. The apparatus of claim 27, wherein a dust introduction hole is formed on one of the cover or an exterior of the second dust storage unit such that dust separated in the second dust separator is introduced into the second dust storage unit via the dust introduction hole.

29. A vacuum cleaner comprising the apparatus of claim 24.

30. The apparatus of claim 1, wherein:

a first central axis passes through the first cyclone dust separator, and a second central axis passes through the second dust separator, wherein the first central axis and the second central axis are not arranged parallel to each other.

31. The apparatus of claim 30, wherein the first central axis is substantially perpendicular to the second central axis.

* * * * *